United States Patent [19]

Googin et al.

[11] 4,405,448

[45] Sep. 20, 1983

[54] PROCESS FOR REMOVING HALOGENATED ALIPHATIC AND AROMATIC COMPOUNDS FROM PETROLEUM PRODUCTS

[75] Inventors: John M. Googin; John M. Napier, both of Oak Ridge; Michael A. Travaglini, Oliver Springs, all of Tenn.

[73] Assignee: The United States of America as represented by the U.S. Department of Energy, Washington, D.C.

[21] Appl. No.: 364,060

[22] Filed: Mar. 31, 1982

[51] Int. Cl.[3] ..... C10G 21/02; C10G 21/12

[52] U.S. Cl. ..... 208/262; 585/864; 570/211; 210/909

[58] Field of Search ..... 208/262; 585/864; 210/909; 570/211

[56] References Cited

U.S. PATENT DOCUMENTS

| | | | |
|---|---|---|---|
| 1,103,499 | 7/1914 | Friese . | |
| 1,584,588 | 5/1926 | Acheson . | |
| 2,484,469 | 10/1949 | Schaeffer | 570/211 |
| 3,249,532 | 5/1966 | Shiah | 585/864 |
| 3,400,171 | 9/1968 | Van Pool | 208/262 |
| 4,105,542 | 8/1978 | Fainman . | |
| 4,154,670 | 5/1979 | Forsberg . | |

OTHER PUBLICATIONS

Chemical & Engineering News, "PCB Process Demonstration Begun," Nov. 2, 1981, p. 2.

*Primary Examiner*—Delbert E. Gantz
*Assistant Examiner*—Anthony McFarlane
*Attorney, Agent, or Firm*—Earl L. Larcher; Stephen D. Hamel; Richard G. Besha

[57] ABSTRACT

A process for removing halogenated aliphatic and aromatic compounds, e.g., polychlorinated biphenyls, from petroleum products by solvent extraction. The halogenated aliphatic and aromatic compounds are extracted from a petroleum product into a polar solvent by contacting the petroleum product with the polar solvent. The polar solvent is characterized by a high solubility for the extracted halogenated aliphatic and aromatic compounds, a low solubility for the petroleum product and considerable solvent power for polyhydroxy compound. The preferred polar solvent is dimethylformamide. A miscible compound, such as, water or a polyhydroxy compound, is added to the polar extraction solvent to increase the polarity of the polar extraction solvent. The halogenated aliphatic and aromatic compounds are extracted from the highly-polarized mixture of water or polyhydroxy compound and polar extraction solvent into a low polar or nonpolar solvent by contacting the water or polyhydroxy compound-polar solvent mixture with the low polar or nonpolar solvent. The halogenated aliphatic and aromatic compounds and the low polar or nonpolar solvent are separated by physical means, e.g., vacuum evaporation. The polar and nonpolar solvents are recovered from recycling. The process can easily be designed for continuous operation. Advantages of the process include that the polar solvent and a major portion of the nonpolar solvent can be recycled, the petroleum products are reclaimable and the cost for disposing of waste containing polychlorinated biphenyls is significantly reduced.

8 Claims, 1 Drawing Figure

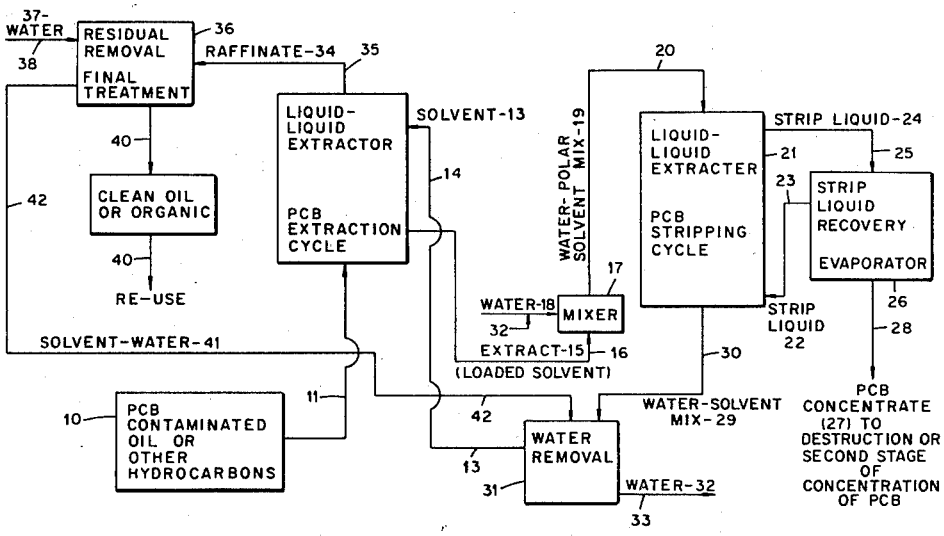

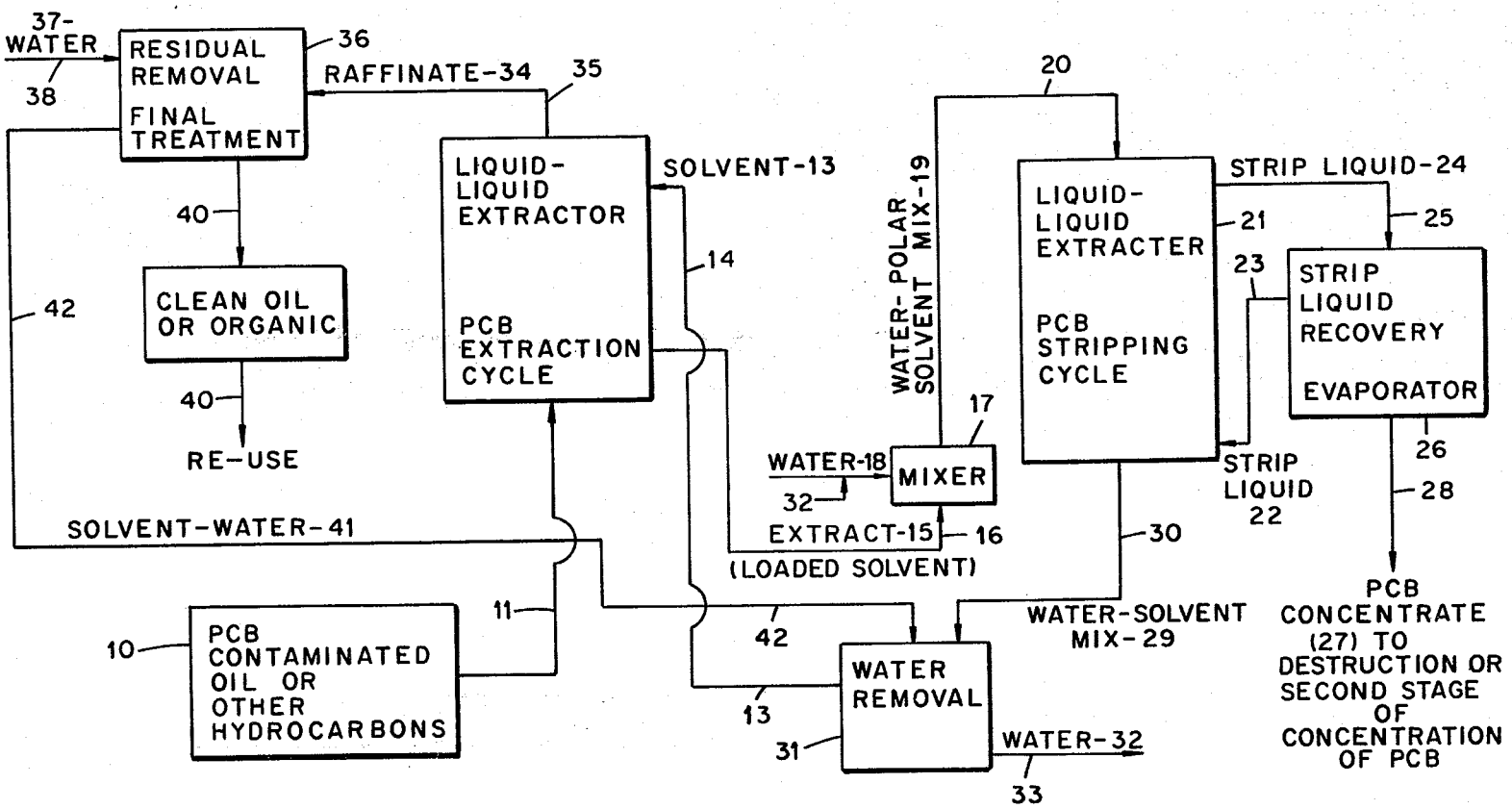
STRIP LIQUID-24
25
STRIP LIQUID RECOVERY
EVAPORATOR
26
28
PCB CONCENTRATE (27) TO DESTRUCTION OR SECOND STAGE OF CONCENTRATION OF PCB
21
23
STRIP LIQUID 22
LIQUID-LIQUID EXTRACTER
PCB STRIPPING CYCLE
30
WATER-SOLVENT MIX-29
20
WATER-32
33
17
MIXER
16
WATER-POLAR SOLVENT MIX-19
WATER REMOVAL
WATER-18
32
EXTRACT-15 (LOADED SOLVENT)
42
31
13
SOLVENT-13
14
35
LIQUID-LIQUID EXTRACTOR
PCB EXTRACTION CYCLE
11
RAFFINATE-34
36
RESIDUAL REMOVAL
FINAL TREATMENT
40
CLEAN OIL OR ORGANIC
40
RE-USE
SOLVENT-WATER-41
PCB CONTAMINATED OIL OR OTHER HYDROCARBONS
10
37-WATER
38
42

PROCESS FOR REMOVING HALOGENATED ALIPHATIC AND AROMATIC COMPOUNDS FROM PETROLEUM PRODUCTS

The United States Government has rights in this invention pursuant to Contract No. W-7405-Eng-26 between the U.S. Department of Energy and Union Carbide Corporation, Nuclear Division [41 C.F.R. §9-9.109-6(i) (5) (ii) (B)].

BACKGROUND OF THE INVENTION

1. Field Of The Invention And Contract Statement

The invention relates to a method for removing halogenated aliphatic and aromatic compounds from petroleum products and more particularly to a method for removing polychlorinated biphenyl from petroleum products.

2. Discussion Of Background And Prior Art

The physical and chemical properties of polychlorinated biphenyls (PCBs) made them attractive for a broad spectrum of applications. In general, the chlorinated, aromatic compounds have excellent chemical, thermal stability and dielectric properties. In particular, the polychlorinated biphenyls are very stable compounds. The PCBs are generally chemically inert and are nonreactive under ordinary circumstances, and consequently, only extreme reagents and reaction conditions form new compounds.

Consequently, the polychlorinated biphenyls have been used as electrical insulating fluids for transformer and capacitors and as industrial fluids for machining coolants, hydraulic systems and vacuum pumps. The PCBs are also applicable as fire retardants, heat transfer agents and plasticizers.

Unfortunately, some of the properties responsible for the broad spectrum of applications of PCBs are also the reason for the health and environmental problems recently associated with polychlorinated biphenyls. The PCB class of compounds is very toxic to living cells, is toxic in small amounts and has systemic toxic effects. Relatively recent investigations have indicated that the PCBs are possibly carcinogenic and induce neoplastic changes in rats.

The polychlorinated biphenyls have accumulated in food chains because of their solubility in fatty tissue and resistance to chemical degration. Basically, the problems attendant with PCBs is that the toxic PCBs are fat soluble, are stored in the lipids of animals and tend to be concentrated in amounts high in the food chain. Also, the resistance of PCBs to thermal, chemical and biological degradation has constributed to the accumulation of the PCBs in particular in industrial environments. The very slow biodegradation rates and considerable resistance to metabolic changes of PCBs makes them almost a ubiquitous environmental problem and contaminant. Consequently, the Environmental Protection Agency (EPA) has severely limited the use of polychlorinated biphenyls and placed stringent restrictions on the disposal of them.

Oils and other organic liquids containing low levels, e.g., less than 10,000 ppm. of polychlorinated biphenyls present considerable disposal problems. Incineration is the only disposal method and currently approved by EPA. Equipment and operational costs for incineration of oils and the like containing low levels of PCB are excessive. The PCBs are usually destroyed by incineration at high temperatures, that is, greater than 1100° C., with long residence time in the incinerators. Ordinary incinerators used to dispose of organic matter normally will tend to vaporize the PCBs instead of converting them to carbon dioxide, water and hydrogen chloride. So an economical and continuous process is needed for concentrating the polychlorinated biphenyls in a small amount of liquid (for subsequent incineration) while purifying the contaminated liquids for further use or separate disposal.

Solvent extraction, distillation and evaporation have been used for separating liquids, concentrating materials in liquids and removing impurities from liquids. The petroleum companies use solvent extraction for adjusting viscosity, controlling impurities and other reasons. Several processes are described in Hess, L. Y., "Reprocessing and Disposal of Waste Petroleum Oils," Noyes Data Corp., (1979). Methods of analysis for polychlorinated biphenyls, including solvent extraction and other analytical techniques, are described in Hutzinger, O., et al., "The Chemistry of PCB's." CRC Press Inc., Fourth Printing, (1980).

SUMMARY OF THE INVENTION

An object of the invention is to provide a method for removing halogenated aliphatic and aromatic compounds from petroleum products and other organic liquids. Another object of the invention is to provide an economical method for removing polychlorinated biphenyls from petroleum products and other organic liquids. A further object of the invention is to concentrate halogenated aromatic and aliphatic compounds, such as, polychlorinated biphenyls is an economically feasible process for disposal by conventional methods. A still further object of the invention is to provide an economical process for reclaiming oil and other organic liquids that contain polychlorinated biphenyls for additional use. Another object of the invention is to provide a continuous process for removing polychlorinated biphenyls from oil and other organic liquids while reclaiming the oils and other organic liquids for additional use. Other objects and advantages of the invention are set out herein or are obvious herefrom to one ordinarily skilled in the art.

The objects and advantages of the invention are achieved by the method of the invention.

To achieve the foregoing and other objects and in accordance with the purpose of the invention, as embodied and broadly described herein the process of the invention includes extracting at least one halogenated aliphatic compound and/or halogenated aromatic compound from a petroleum product or other organic liquid into a polar solvent by contacting the petroleum product with the polar solvent. The polar solvent is characterized by a high solubility for the extracted halogenated aliphatic and aromatic compounds, a low solubility for the petroleum product and considerable solvent power for water and polyhydroxy compounds. Water or a miscible polyhydroxy compound is added to the polar extraction solvent containing the extracted halogenated aliphatic and aromatic compounds to increase the polarity of the polar extraction solvent. The halogenated aliphatic and aromatic compounds are extracted from the highly-polarized mixture of polyhydroxy compound or water and polar extraction solvent into a low polar or nonpolar solvent by contacting the polyhydroxy compound or water-polar solvent mixture with the low polar or nonpolar solvent. The halogenated aliphatic and aromatic compounds in the low polar or nonpolar solvent are concentrated by physical means.

The invention process provides outstanding results with the extraction of polychlorinated biphenyls from liquid petroleum oils.

Most preferably the polar solvent is dimethylformamide, although a very favorable polar solvent is furfural. The polar solvent should be one which provides an extraction distribution ratio of extracted halogenated aliphatic and aromatic compounds in the polar solvent to remaining halogenated aliphatic and aromatic compounds in the petroleum product of at least 0.2. Most preferably the polar solvent provides an extraction distribution ratio of at least 1. Also preferably the extraction steps are conducted in a countercurrent manner. Preferably the hydroxy compound is water but can be an organic polyhydroxy compound preferably, glycerol or a glycol. The preferred nonpolar solvent is a pentane-to-octane fraction.

In the process, preferably the polar solvent and the nonpolar are recovered and recycled by reuse in the respective extraction steps. Preferably the polar solvent is separated from the water-solvent mixture from the extraction step by means of distillation. Also preferably the concentration step is achieved by means of an evaporator. Preferably the treated petroleum product from extraction step (a) is treated with water to remove residual polar solvent therein and the water-polar solvent mixture is treated to remove the polar solvent.

The principle of the process of the invention is two-stage extraction with alteration of the polarity relationships between the two extraction stages. The addition of the polyhydroxy compound is preferably one which substantially increases the polarity of the polar solvent.

The process of the invention provides an economical process for the reclaiming of petroleum products containing halogenated aliphatic and aromatic compounds. The cost of disposing of waste containing polychlorinated biphenyls is significantly reduced by the process of the invention. The polar solvent and a major portion of the non-polar solvent can be recovered and recycled. The invention process is a simple and economic method for concentrating PBCs and recovering the mother liquid for additional use. The process can easily be designed so as to operate on a continous basis.

The process of the invention is particularly effective in removing polychlorinated biphenyls from petroleum products.

Reference will now be made in detail to the present preferred embodiment of the invention, an example of which is illustrated in the accompanying drawing.

A BRIEF DESCRIPTION OF THE DRAWING

The accompanying drawing, which is incorporated in and forms a part of the specification, illustrates the invention and, together with the description, serves to explain the principles of the invention.

In the drawing:

The FIGURE is a flow diagram of the method of the invention.

DETAILED DESCRIPTION OF THE INVENTION

As used herein, all parts, percentages, ratios and proportions are on a weight basis unless otherwise stated herein or otherwise obvious herefrom to one ordinarily skilled in the art.

Referring to the FIGURE, a preferred embodiment is disclosed of the continuous mode of the process of the invention for removing polychlorinated biphenyls from liquid petroleum products in which the polychlorinated biphenyls are extracted into a polar solvent, released from the polar solvent by mixture with water, extracted into a nonpolar solvent, and concentrated by a physical means. PCB contaminated oil or other hydrocarbon (10) is fed via line 11 into the bottom of countercurrent extractor 12, which provides the PCB extraction cycle. A liquid oil or other hydrocarbon feed is used. Polar solvent (13) is fed via line 14 into the top of countercurrent extractor 12, wherein liquid-to-liquid contact occurs. Extract or loaded polar solvent 15 is polar solvent 13 containing extracted PCB. Extract 15 is fed via line 16 to mixer 17 where it is mixed with water 18. Water-polar solvent mixture 19 is fed via line 20 into the top of countercurrent extracter 21, which provides the PCB stripping cycle. Stripping (liquid) solvent 22, a nonpolar solvent, is fed via line 23 into the bottom of extracter 21, wherein liquid-to-liquid contact occurs. Loaded stripping liquid 24 is stripping liquid 22 containing PCB. Loaded stripping liquid 24 is fed via line 25 to stripping liquid recovery stage 26, which is preferably an evaporated. Recovered stripping liquid 22 is recycled from recovery stage 26 via line 23 into extracter 21. PCB concentrate 27 is sent via line 28 to a destruction (incineration site, not shown) or to a second stage of PCB concentration (e.g., a second evaporator, or fractionator, not shown). The stripped water-polar solvent mixture 29 is sent via line 30 to water removal stage 31, with water 32 (which may be reused as part of water 18) exiting via line 33 and solvent 13 being recycled via line 14 to extracter 12. Raffinate 34 from extracter 12 is fed via line 35 to final treatment stage 36, for solvent residuals removal from raffinate 34. Raffinate 34 is extracted PCB-contaminated oil 10. Water 37 is fed via line 38 into treatment stage 36. Clean oil 39 exits from extracter 36 via line 40 for reuse. Solvent-water 41 exiting from extracter 36 via line 42 contains some polar solvent 13 and is sent to water removal stage 31 for solvent recovery.

The process of the invention is most preferably used to extract polychlorinated biphenyls. Most PCBs are mixtures of the isomers of trichlorobiphenyl, tetrachlorobiphenyl, pentachlorobiphenyl and small amounts of dichlorobiphenyl and hexachlorobiphenyl.

In polychlorinated biphenyls, the chlorine carbon bond is much more polar than the hydrogen carbon bond with the result that unsymetrically substituted chlorocarbons show a strong dipole moment, and the individual chlorine carbon bonds can undergo the usual dipole-dipole interactions.

Examples of specific halogenated biphenyls (aromatic compounds) which can be extracted are 2-chlorobiphenyl, 3-chlorobiphenyl, 4-chlorobiphenyl, 4,4'-dibromobiphenyl, 4,4'-dichlorobiphenyl, 4,4'-difluorobiphenyl, 2-iodobiphenyl and 4-iodobiphenyl.

Polyhalogenated polyphenyls (i.e., biphenyls, terphenyl, higher polyphenyls and mixtures thereof) can be extracted from petroleum products using the process of the invention. The process can be adapted to separate many compounds more polar than the basic hydrocarbons from petroleum products.

The process of the invention is used to extract halogenated hydrocarbons, such as, halogenated aliphatic and aromatic compounds. Preferably the process is used to extract the polychlorinated biphenyls from petroleum products.

As used within the scope of the invention, the phrase petroleum products include: the various refinery fractions of crude oil, such as, the light distillates, e.g., the motor gasolines, the solvent naphthas, kerosene and the light heating oils, the intermediate distillates, e.g., the heavy fuel oils, diesel oils and gas oils, the heavy distillates, e.g., the heavy mineral oils, the heavy floatation oils and the lubricating oils (large range), and the residues, e.g., the lubricating oils and the fuel oils. Included are the blended and treated fractions.

Preferably the petroleum products, such as waste oils or other liquids are at most only slightly soluble in the extraction polar solvent. The halogenated aliphatic and aromatic compounds are released from the extraction solvent by increasing the polarity of the solvent with water. Then the compounds are extracted into a low polar solvent from the water-polar solvent mixture. The low polar and polar solvents can be recovered by physical or chemical methods. This type of process is easily designed for continuous operation, which is the preferred mode.

Polychlorinated biphenyls are soluble in most organic solvents and are insoluble in water and polyhydroxy liquids, such as, glycerol and the glycols. But, the polychlorinated biphenyls and other chlorinated hydrocarbons have exhibited a preferential solubility for polarized solvents. Because of their polar nature PCBs are more soluble in many polar solvents than in the various hydrocarbons and those polar solvents which yield extraction distribution coefficients of orders of one have potential for use in commercial processes. The extraction distribution ratio is the ratio of the PCB concentration in the extraction solvent phase to the PCB concentration in the oil phase. Preferably the polar solvent has an extraction distribution coefficient of at least one, but other polar solvents with a less favorable coefficient can be used.

In general, the more suitable solvents for extracting polychlorinated biphenyls from petroleum products have a strongly polar structure, but do not have the strong hydrogen bonding tendencies of the water and polyhydroxy structures. The characteristics of the extraction solvent should include a high solubility for the polychlorinated biphenyls, a low solubility for oils, and considerable solvent power for water.

A most preferred polar solvent is dimethylformamide, which is an aprotic solvent. A very preferred polar solvent is furfural.

Useful polar solvents include: alcohols, such as, methanol, ethanol, n-propyl alcohol, n-butyl alcohol, amyl alcohol, isopropyl alcohol, sec-butyl alcohol, isobutyl alcohol and 4-methyl 2 -pentanol; ethers, such as, ethyl ether, diethyl Cellosolve and butyl ether; aldehydes, such as, benzaldehyde and furfural; triethyl phosphate, amides, such as, N,N-dimethyl formamide (most preferred), acetamide and butramide; and ketones, such as, acetone, methyl ethyl ketone, methyl isobutyl ketone, ethyl amyl ketone, cyclohexanone and 4-methyl-4-methoxy-2-pentanone. But it must be remembered that the best results are obtained by polar solvents characterized by a high solubility for the extracted compounds, a low solubility for oils, and considerable solvent power for water.

Furthermore, polar solvents should generally be used which have an extraction distribution ratio of at least 0.5. Such polar solvents are included within the scope of the invention as they are operable. The unexpected results obtained by the process of this invention are definitively obtained when the extraction distribution ratio is at least 1.0.

The preferred hydroxy compound is water. An amount of the hydroxy compound should be added to the polar extraction solvent that is effective in preventing the halogenated aliphatic and/or aromatic compound from being soluble in the polar extraction solvent. Typically the amount of water which is required to be added to the polar extraction solvent to cause polychlorinated biphenyls from being soluble in the polar extraction solvent is at least 5 volume percent—preferably the amount of water is at least 7 volume percent and most preferably 8 volume percent of water is used. The upper limit theoretically has no upper limit, but a practical upper limit is 50 to 100 or say 150 volume percent of water.

Separation of the water from the polar solvent is done by distillation (fractional is best), but can be achieved by any convention methods such as, activated carbon beds, beds of other adsorbents, evaporators (including vacuum types), etc.

The preferred means for concentrating the PCB-nonpolar solvent mixture is an evaporator (vacuum is best), with the solvent vapors being condensed for recycle.

The two liquid-liquid extraction steps may involve dissolved solids depending upon which halogenated aliphatic or aromatic compounds are present as contaminants.

Nonpolar hydrocarbon solvents used to extract or strip the halogenated aliphatic and aromatic compounds from the water-polar solvent mixture include: the straight-chain alkanes, such as, n-pentane, n-hexane, n-heptane and n-octane; aromatic compounds, such as, benzene, toluene and xylene; alicyclic compounds, such as, cyclohexane; and mixtures thereof. The preferred nonpolar solvent is n-pentane to n-octane fraction.

Halogenated aliphatic and aromatic compounds, such as, polychlorinated biphenyls, can be extracted from oil mixtures into dimethylformamide or furfural, polar solvents, then released from the dimethylformamide or furfural with water, and extracted into a nonpolar solvent, such as, hexane. The polychlorinated biphenyls can be enriched in the hexane or another nonpolar extraction solvent by physical means, such as, distillation or evaporation of the nonpolar solvent. Such process is very economical and efficient. At the present time the cost for incinerating one gallon of petroleum products contaminated with polychlorinated biphenyls is approximately 10 dollars, whereas the cost per gallon for disposal by the process of the invention can be reduced by a factor of 50 percent or more. Also, other considerable savings can be realized in the process of the invention by recovering the petroleum products for additional use. Industrial, university and governmental facilities, for example, using fluids that contain polychlorinated biphenyls can realize substantial savings by utilizing the process of the invention.

EXAMPLE 1

A mixture of lubricating and coolant oils was spiked with 1935 ppm of polychlorinated biphenyls. Equal aliquots of the oil mixture and furfural were added to a separatory funnel, and then mixed for about 30 seconds by shaking the separatory funnel. After the two phases were separated, aliquots from each phase were obtained for analysis. The analyses indicated that the furfural contained 1100 ppm of polychlorinated biphenyls and that the oil mixture contained 935 ppm of polychlorinated biphenyls.

The test was continued by adding an aliquot of the oil mixture containing 1935 ppm of polychlorinated biphenyls to another separatory funnel, and then adding the same amount of furfural plus an aliquot of water which was 4 vol. percent of the furfural. The mixture of oil, furfural and water was mixed for about 30 seconds by shaking the separatory funnel. After the two phases in the separatory funnel separated, aliquots from each phase were obtained for analysis. The analyses indicated that the oil phase contained 975 ppm of polychlorinated biphenyl and that the furfural plus water phase contained 1220 ppm of polychlorinated biphenyls. The results of the analyses indicated that the increase in polarity of furfural with 4 vol. percent of water had not prevented extraction of the polychlorinated biphenyls into the furfural.

In continuing the experiment, aliquots equal in volume of an oil mixture containing 1935 ppm of polychlorinated biphenyls and furfural were added to a separatory funnel. Then an aliquot of water, which was 8 vol. percent of the furfural aliquot was added. The oil mixture, furfural and water were mixed for about 30 seconds by shaking the separatory funnel. After the materials had separated in the funnel, aliquots were obtained from the oil mixture and the furfural plus water for analyses. The analyses indicated that the oil mixture contained 1985 ppm of polychlorinated biphenyls. No polychlorinated biphenyls above tfhe analytical limit were detected in the furfural plus 8 vol. percent water mixture. These analyses indicated that the furfural was changed from a balanced polar solvent to a highly polar solvent which suppressed extraction of the polychlorinated biphenyls.

EXAMPLE 2

Uninhibited mineral oil and waste lubricating oils were contaminated with varying amounts of PCBs for use in testing various solvents for the subject extraction process. In each case equal volumes of the waste oils and solvents were shaken in separatory funnels for approximately 0.5 minutes. The results of the extractions were presented below in Table 1. Three solvents (dimethyl formamide, triethyl phosphate and furfural) were selected on the basis of the extraction data for more extensive testing. Of these, dimethyl formamide was the best candidate with an extraction distribution ratio ranging from 1.15 to 2.42. The triethyl phosphate was considered a good candidate on the basis of the extraction data. However, triethyl phosphate is hydrolyzed much more rapidly than dimethyl formamide in water, so it was excluded from preferable status for the subject process. The extraction distribution ratio for furfural was 0.76 to 1.18 and could be used economically, but the lower distribution coefficient would require large equipment.

Generally speaking, all of the solvents in Table 1 (except for V. 1 and 2 and IX. 2 to 7) are useful within the broadest scope of the invention.

TABLE 1

SUMMARY OF TESTS

| Solvents | | PCB Concentration (ug/g) Solvent Phase | PCB Concentration (ug/g) Oil Phase | Extraction Distribution Ratio Solvent/Oil |
|---|---|---|---|---|
| I. | Acids | | | |
| | 1. Acetic | 1260 | 1940 | 0.65 |
| | 2. Phenol | 3200 | 4300 | 0.74 |
| II. | Alcohols | | | |
| | 1. Methyl | 510 | 3600 | 0.14 |
| | 2. Methyl plus diethylene glycol | 400 | 3410 | 0.12 |
| | 3. Methyl plus 0.3 wt. % potassium hydroxide | 840 | 2590 | 0.32 |
| | 4. Methyl plus 0.5 wt. % KOH | 950 | 2430 | 0.39 |
| | 5. 85 v/o Methyl plus 15 v/o H Ac | 1010 | 2320 | 0.44 |
| | 6. 98 v/o Methyl plus 2 v/o myristic acid | 555 | 1410 | 0.39 |
| | 7. Ethanol | 4000 | 1900 | 0.475 |
| III. | Aldehydes | | | |
| | 1. Furfural | 1100 | 938 | 1.18 |
| | 2. Furfural and 4 wt. % water | 1220 | 975 | 1.25 |
| | 3. Furfural and heavy phase separated 8 wt. % water | 0 | 3115 | — |
| | 4. Furfural | 29 | 38 | 0.76 |
| | 5. Benzaldehyde | 2000 | 2800 | 0.71 |
| IV. | Amides | | | |
| | 1. N,N—dimethylformamide (DMF) | 1703 | 705 | 2.42 |
| | 2. DMF | 40 | 28 | 1.43 |
| | 3. DMF | 4500 | 3900 | 1.15 |
| | 4. Acetamide | 1700 | 6500 | 0.26 |
| V. | Glycols | | | |
| | 1. Glycerol | 0 | 1800 | 0 |
| | 2. Propylene glycol | 220 | 12000 | 0.02 |
| VI. | Methyl Organics | | | |
| | 1. Tri-ethyl phosphate | 30 | 30 | 1.0 |
| | 2. Tri-ethyl phosphate | 1840 | 1375 | 1.34 |
| VII. | Nitrogen Compounds | | | |
| | 1. Acetonitrile | 764 | 4080 | 0.19 |
| | 2. Pyridine | 1800 | 6200 | 0.29 |
| VIII. | Sulfur Compounds | | | |
| | 1. Dimethyl sulfoxide | 2700 | 6000 | 0.45 |
| IX. | Miscellaneous | | | |
| | 1. Acetone | 620 | 6000 | 0.103 |
| | 2. Hydraulic fluid - glycol base | 1700 | 4500 | 0.38 |
| | 3. Triethylene glycol | 380 | 5800 | 0.066 |
| | 4. Ethylene glycol | 11 | 6200 | 0.002 |
| | 5. Polyethylene glycol #400 | 1200 | 4600 | 0.26 |
| | 6. Polyethylene glycol #1000 (45° C.) | 2900 | 3300 | 0.88 |
| | 7. Polyethylene glycol #2000 in water | 0 | — | 0 |
| | 8. Ethyl acetate | 3400 | 2400 | 1.42 |
| | 9. Diethyl Oxalate | 3000 | 1800 | 1.67 |
| | 10. Acetophenone | 2400 | 2900 | 0.83 |

EXAMPLE 3

Halogenated aliphatic and aromatic (PCBs) in waste oils are extracted into dimethyl formamide. After separating the oil and solvent phases, an aliquot of water is dissolved in the dimethyl formamide to increase the polarity of the solvent. The oil dissolved in the solvent during the extraction is released by the water so that two liquid phases are formed. The oil phase with added hydrocarbon is then utilized as a non-polar solvent for stripping the halogenated aliphatic and aromatic compounds from the highly polar dimethyl formamide-water mixture. The halogenated aliphatic and aromatic compounds are sufficiently concentrated in the oil for disposal by conventional methods. The recovered waste lubricant and transformer oils is about 95 percent of the materials fed to the process. The diemthyl formamide is reclaimed for reuse by removing the water from the solvent in a distilling operation. The same cycle can be repeated if further concentration of the PCBs from the oil is required.

The loss of 5 to 10 percent of the waste oils in the subject process is not exceedingly expensive and can be substantially reduced by processing them through a second cycle. However, the cost of physical decomposition of the waste oil in the 5 to 10 percent loss justifies the use of a second cycle.

EXAMPLE 4

Waste oils were contaminated with known quantities of methylene chloride, perchloroethylene, chloroform, trichlorofluoroethane, trichloroethylene and chlorobenzene. The halogenated compounds were extracted from the oils in separate operations with dimethylformamide. The results of the extractions are listed below in Table 2:

TABLE 2

SOLVENT EXTRACTED WITH DMF CHLORINATED HYDROCARBONS*

| Contaminant | $K = \frac{\text{Conc. DMF}}{\text{Conc. Oil}}$ |
|---|---|
| Methylene chloride | 1.26 |
| Perchloroethylene | 1.13 |
| Chloroform | 1.15 |
| Trichlorofluoroethane | 1.04 |
| Trichloroethylene | 1.16 |
| Chlorobenzene | 0.82 |

Note:
*Samples of waste oil were prepared with 1000 to 6000 ppm of chlorinated hydrocarbon.

EXAMPLE 5

A pilot plant is constructed (at the Oak Ridge Y-12 Plant) which embodied the aspects and equipment of the Figure, which is described above in detail. The pilot plant is capable of processing approximately 10 gallons per hour of petroleum products containing halogenated aliphatic and aromatic compound contaminants. The petroleum products are waste lubricating and transformer oils. A considerable monetary sum can be saved by utilization of the subject process. For example, the cost for incinerating one gallon of waste oils contaminated with polychlorinated biphenyls is currently about 10 dollars. It is believed that the cost per gallon for disposing of these products can be reduced at least 50 percent. Also, considerable savings can be realized by recovering the waste lubricating and transformer oils for additional use.

By way of summary, the invention involves a process of removal of halogenated aliphatic and/or aromatic compounds, such as, polychlorinated byphenyls, from petroleum products. The process includes extracting the halogenated aliphatic and/or aromatic compounds from the petroleum products into a polar solvent, such as, furfural, dimethyl formamide, ethers and alcohols. The polarity of the polar solvent containing the halogenated compounds is increased by the addition of a polyhydroxy compound, such as water. The halogenated compounds were extracted using a low polar or nonpolar solvent from the water or polyhydroxy compound polar solvent mixture. The halogenated compounds in the low-polar solvent are concentrated or enriched by physical means.

The foregoing description of preferred embodiments of the invention has been presented for purposes of illustration and description. It is not intended to be exhaustive or to limit the invention to the precise form disclosed, and obviously many modifications and variations are possible in light of the above teaching. For example, the two extraction steps of the invention can be achieved in cocurrent extracters instead of the countercurrent extracters shown in the Figure. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A process for removing polychlorinated biphenyls from petroleum products by solvent extraction, comprising the steps of:

contacting a petroleum product containing a polychlorinated biphenyl with an adequate volume of a polar solvent selected from the group consisting of dimethyl formamide and furfural for extracting essentially all of the polychlorinated biphenyl frm the petroleum product;

separating the resulting extract phase of the polar solvent and extracted polychlorinated biphenyl from the raffinate phase;

contacting the extract with an adequate volume of water or a polyhydroxy compound to extract the polychlorinated biphenyl from the polar solvent; and recoverng polar solvent and water or polyhydroxy compound with essentially all of the polychlorinated biphenyl removed therefrom.

2. The process as claimed in claim 1 wherein the step of recovering the polar solvent and the water or polyhydroxy compound comprises stripping the polychlorinated biphenyl from the resulting mixture of polychlorinated biphenyl, polar solvent and water or polyhydroxy compound by contacting the mixture with a nonpolar solvent having a relatively low vapor pressure and a volume adequate to effect said stripping, separating the resulting polar solvent and water or polyhydroxy compound phase from the phase formed of the nonpolar solvent containing polychlorinated biphenyl, and thereafter concentrating the polychlorinated biphenyl by depleting the nonpolar solvent from the phase of the nonpolar solvent containing polychlorinated biphenyl.

3. A process as claimed in claim 1 including the additional steps of separating water or the polyhydroxy compound from the recovered polar solvent and water or polyhydroxy compound phase, and thereafter recycling the polar solvent into contact with the petroleum product containing polychlorinated biphenyl.

4. A process as claimed in claim 1 wherein a minor portion of the petroleum products is dissolved in the polar solvent, wherein water is used to extract the polychlorinated biphenyl from the polar solvent, and wherein the petroleum products dissolved in the polar solvent are released during the contact with the water to form two liquid phases defined by the released petroleum products containing extracted polychlorinated biphenyl and the polar solvent and water.

5. A process as claimed in claim 1 wherein the polyhdyroxy compound is glycerol or a glycol.

6. A process a claimed in claim 1 wherein the petroleum product is transformer oil.

7. A process as claimed in claim 2 wherein the nonpolar solvent is an n-pentane to n-octane fraction.

8. A process as claimed in claim 7 wherein the step of concentrating the polychlorinated biphenyl by depleting the nonpolar solvent is achieved by evaporation.

* * * * *